US005685753A

United States Patent [19]

Canela et al.

[11] Patent Number: 5,685,753

[45] Date of Patent: Nov. 11, 1997

[54] FLOATING DEVICE

[76] Inventors: Heriberto Canela, 8027 W. 14th Ave., Hialeah, Fla. 33014; Steve Zabielinsky, 8390 SW. 94 St., Miami, Fla. 33156

[21] Appl. No.: 730,127

[22] Filed: Oct. 15, 1996

[51] Int. Cl.[6] ..... B63C 9/08

[52] U.S. Cl. ..... 441/129; 441/135

[58] Field of Search ..... 441/115, 125–130, 441/132, 135, 136; 472/129; D21/238; D12/300, 307

[56] References Cited

U.S. PATENT DOCUMENTS

| | | | |
|---|---|---|---|
| 4,580,988 | 4/1986 | Correll | 441/130 |
| 4,662,851 | 5/1987 | Foster | 441/129 |
| 4,723,329 | 2/1988 | Vaccaro | 441/135 |
| 4,844,595 | 7/1989 | Nealy | 441/135 |
| 4,986,786 | 1/1991 | Helt et al. | 441/129 |
| 5,052,965 | 10/1991 | Klapp et al. | 441/130 |
| 5,562,514 | 10/1996 | Rowe | 441/129 |

*Primary Examiner*—Edwin L. Swinehart

[57] ABSTRACT

A floating device, used as a floating chair, for supporting a user over a body of water and having three sections: first, second and third sections, where the second section includes two bays to cooperatively receive a user's legs when she or he sits down on it. The first section of the floating device includes handle members to hold and maneuver the floating member in the water, and a through opening with a transparent member rigidly mounted therein to permit the user to look through it.

4 Claims, 2 Drawing Sheets

FLOATING DEVICE

BACKGROUND OF THE INVENTION

1. Field of the Invention

The present invention relates to a floating device, and more particularly, to the type that can be used as a chair in the water.

2. Description of the Related Art

Several floating devices exist nowadays, however none of them include such a structure that permits a user to sit down on the floating device and two bays allowing user's legs to spread to both sides thereby providing the maximum of equilibrium and comfort. Also, the present invention discloses apertures which provide a user handle means to hold and maneuver the floating device over the waves of the sea.

SUMMARY OF THE INVENTION

It is one of the main objects of the present invention to provide a floating device that permits a user to sit down or lie in the water and float, while maintaining the stability.

It is another object of this invention to provide a floating device that has two bays to receive the user's legs when she or he sits down on the floating device.

It is another object of this invention to provide a floating device that has a through opening with a transparent material that permits a user to look through while a user lies down on the floating device.

It is still another object of the present invention to provide a floating device that includes apertures for the user to hold and maneuver the floating device on the water.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
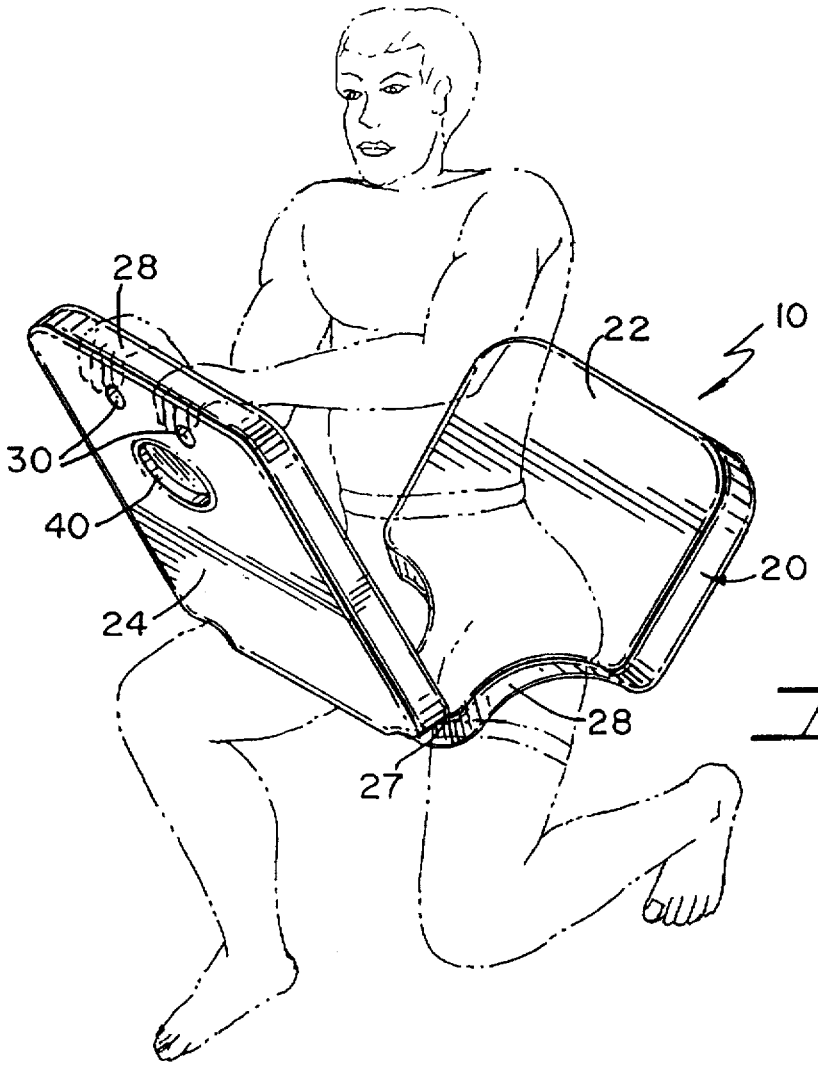
FIG. 1 is an isometric view of the floating device with a user sitting on it.

Referring now to the drawings, where the present invention is generally referred to with numeral 10, it can be observed that it basically includes floating member 20 with holes 30 and through opening 40 located at one substantial end of floating member 20.

Figure 2:
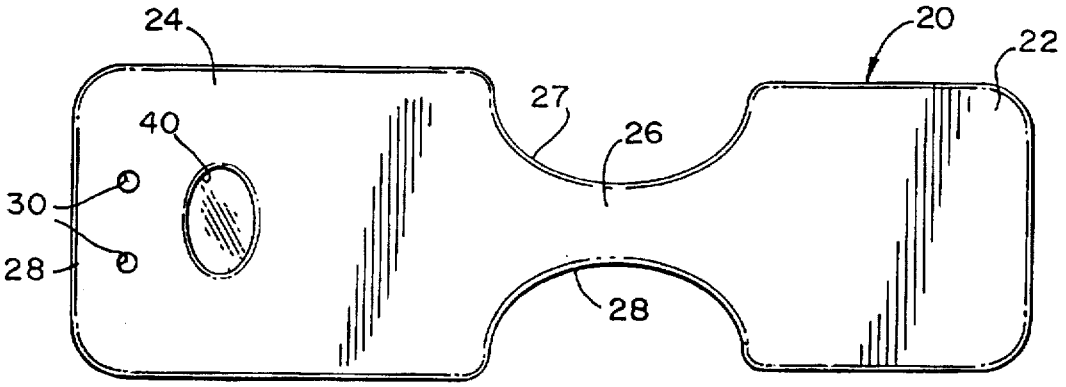
FIG. 2 is a top view of the present invention.
Figure 3:
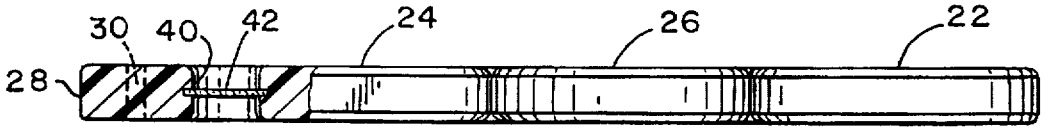
FIG. 3 is an elevational partial cross section of this invention.

Floating member 20, as shown in FIGS. 1 through 3, is a flat elongated member having sections 22 and 24 interconnected through/by section 26. The contacting area of section 22 is shorter on length in comparison with section 24.

Section 26 is located in the substantial middle portion of floating member 20 and includes bays 27 and 28. Bays 27 and 28 are disposed at both sides of section 26 and are designed to receive a user's legs when she or he sits down on section 22 or section 26. Section 26 has enough reduced width to permit it to be bent when a user applies his or her weight on that section. In this manner, a user sits down on section 26 spreading his or her legs along bays 27 and 28, and floating member 20 bends bringing sections 22 and 24 towards. Floating member 20 is converted to a comfortable seat in the water, that allows it to displace over the waves of the sea.

Section 22 receives the user's back and her or his hands hold distal end 28 of section 24 and/or holes 30, as best seen in FIG. 1.

Another application for floating device 10 can be practiced when a user sat down, as described above, holds distal end 28 and pushes down section 24 minimizing the angle of inclination between the surface of section 24 and the horizontal water surface. In this manner, the water resists the force and pressure applied and a user exercises her or his muscles of her/his hands and torso.

Floating device 10, in the preferred embodiment, also includes through opening 40 located in section 24. Through opening 40 has a transparent member 42 rigidly mounted thereto, as best seen in FIG. 3. Through opening 40 is designed for a user to look through it when she or he lies down on floating device.

Floating member 20 can be used flatted and a user can lie on it or use it just as a floating supporting device in the water, as illustrated in FIGS. 2 and 3.

Section 24 also can be used as a seat member floating in the water while section 22 as a back member when a user applies a force downwardly to section 24 and section 26 bends.

Floating member 20 is preferably made out of a polyethylene foam light material or any inflatable material.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A floating device, used as a floating chair, for supporting a user over a body of water, comprising:

A) an elongated floating member having first and second ends and including first, second and third sections along the length of said elongated floating member, and said second section is located in the substantial middle portion of said floating member and inbetween of first and third sections and said elongated floating device is horizontally disposed with respect to a horizontal supporting surface, and said second section has a sufficient width to permit said floating device to be bent on said second section by the user's weight when said user applies a force downwardly to said second section wherein said first section includes handle means located substantially next to said first end of said first section to hold and maneuver said floating member in the water by the user, and wherein said first section includes a through opening with a transparent member rigidly mounted within said through opening for a user to look through it; and B) two bays located in said second section and inwardly disposed to cooperatively receive user's legs when said user sits down on said second section.

2. The floating device set forth in claim 1 wherein said floating device is made out of polyethylene foam material.

3. The floating device set forth in claim 1 wherein said floating device is made out of an inflatable material.

4. The floating device set forth in claim 1 wherein said handle means includes two openings located next to each other and sufficiently spaced apart to cooperatively receive user's thumbs.

* * * * *